US005871394A

United States Patent [19]

Mattson et al.

[11] Patent Number: 5,871,394

[45] Date of Patent: Feb. 16, 1999

[54] MULTIPLE HEAD FLOOR SANDER

[75] Inventors: Bryan Mattson, Delton; Michael T. Powers, Woodland, both of Mich.

[73] Assignee: Floor Style Products, Inc., Hastings, Mich.

[21] Appl. No.: 989,376

[22] Filed: Dec. 12, 1997

[51] Int. Cl.[6] ..... B24B 23/06

[52] U.S. Cl. ..... 451/350; 451/355; 451/361; 451/310; 451/342; 451/461

[58] Field of Search ..... 451/350, 361, 451/28, 342, 355, 461, 309, 310

[56] References Cited

U.S. PATENT DOCUMENTS

| | | |
|---|---|---|
| 2,483,720 | 10/1949 | Asbury . |
| 2,759,305 | 8/1956 | Helbig . |
| 2,780,897 | 2/1957 | Radase . |
| 2,819,565 | 1/1958 | Werth . |
| 2,905,213 | 9/1959 | Levine . |
| 2,948,088 | 8/1960 | Jepson . |
| 3,648,413 | 3/1972 | Godwin et al. . |
| 4,317,282 | 3/1982 | Pace . |
| 5,012,617 | 5/1991 | Winstanley . |
| 5,224,301 | 7/1993 | Tasikas . |
| 5,341,605 | 8/1994 | Tasikas . |

*Primary Examiner*—Robert A. Rose
*Assistant Examiner*—George Nguyen
*Attorney, Agent, or Firm*—Frank J. Uxa

[57] ABSTRACT

A floor sander having a number of interchangeable sanding head assemblies for sanding a surface such as a hardwood floor. Each of the interchangeable sanding head assemblies includes a sanding implement which may provide differing levels of sanding or other surface action. The desired sanding head assembly is attached with a main housing of the floor sander using a connect assembly attached to each of the sanding head assemblies. A plurality of locking devices mounted within each connect assembly engages an equal number of locking pins extending from the main housing to secure the sanding head assembly to the main housing. An alignment device is provided on the main housing to insure proper alignment of each sanding head assembly with both the drive motor and the surface to be sanded.

20 Claims, 2 Drawing Sheets

MULTIPLE HEAD FLOOR SANDER

FIELD OF THE INVENTION

This invention relates generally to surface sanding devices and more particularly, to a floor sander having a number of interchangeable sanding heads.

BACKGROUND OF THE INVENTION

Sanding is often required when installing, renovating or repairing hardwood floors. This floor sanding is preferably accomplished in two steps, each requiring the use of a separate piece of equipment. The first piece of equipment is generally a drum-type sander. The drum sander essentially comprises a cylindrical drum, around which a strip of abrasive material is secured. A motor rotates the drum along with the strip of abrasive material. The drum is moved around the hardwood floor surface and sands it smooth.

Drum sanders are primarily used first because of their ability to quickly and efficiently sand large areas of hardwood floors. However, drum sanders tend to chatter and vibrate, leaving chatter marks and/or other imperfections on the floor. Thus, the quality of the surface finish is somewhat impaired. These disadvantages are generally due to the gap or slot in the drum where the abrasive material is inserted and secured.

After drum sanding is complete, a belt-type sander can be used to provide the desired surface finish. Belt-type sanders essentially include a sanding drum and a tension roller adjacent the drum. An endless belt of abrasive material is arranged around the drum and tension roller. The drum is then driven by a motor causing the belt to rotate and abrade the hardwood surface. This continuous sanding belt allows belt-type sanders to typically produce a higher quality surface finish than drum-type sanders. However, belt sanders are considerably more expensive to operate than drum sanders due to the expensive and rapidly consumed endless belts utilized. As a result, belt sanders are more efficient for the final or finish sanding of the floor after the drum sander has been used.

Previously, the need for both a drum-type sanding device and a belt-type sanding device required the purchase of two separate sanding machines. Although expensive to purchase, the two step finish generally provided the most efficient and highest quality finish. In addition, each piece of equipment had to be separately transported, set up, and handled.

More recently, dual mode floor sanders have been introduced. These sanding devices allow for both drum and belt sanding using a single floor sanding machine with a single convertible sanding head. The sanding head can be converted to function as either a drum or belt-type sander. However, these devices require some disassembly and assembly before either of the drum or belt-type sander can be used. In addition, the belt-type sander typically retains a slot for installation of the sanding paper. Because of this slot, these convertible devices retain the disadvantages of the prior art drum sanders, such as sanding marks. These dual mode sanders typically support the drum on only one side which can cause disadvantageous flexing of the frame and/or the drum shaft. Further, if a tool or conversion part is lost or otherwise misplaced, the floor sander may be prevented from being utilized. The need to work within the sanding head also creates a potentially dangerous working environment since the sanding head may still be connected to the drive motor.

There is thus a need for a single floor sander which includes both a fully assembled drum-type sanding head assembly and a fully assembled belt-type sanding head assembly, both of which are interchangeable with the sander main housing. There is also a need for such a device where the belt-type sanding head assembly is slot free. There is also a need for a quick connect/disconnect device for assembling each of these interconnectible and interchangeable sanding head assemblies. There is also a need for such a device which is economical, simple to use, and not expensive.

Summary

The present invention satisfies the need for a floor sander capable of both drum and belt sanding by providing a single floor sanding device having a number of interchangeable sanding head assemblies. In one configuration, the floor sander of the present invention is configured with a first sanding head assembly having a belt-type sanding implement. In this configuration, the floor sander is used to belt sand the surface of the hardwood floor. In a second configuration, the floor sander is fitted with a second sanding head assembly having a drum-type sanding implement. This implement preferably is supported on both sides of the shaft which reduces flexing and/or allows more aggressive sanding. In this configuration, the floor sander is used to drum sand the surface of the hardwood floor.

The present invention also satisfies the need for a quick connect/disconnect between a floor sander and a variety of interchangeable sanding head assemblies. The quick connect/disconnect assembly of the present invention allows for quick attachment or removal of one of the sanding head embodiments which is secure, vibration resistant and doesn't require any special tools. The quick connect/disconnect assembly also allows for modifying the sanding head type without having to work within the interior of an operable floor sander.

The floor sander of the present invention comprises a main housing, including a drive motor, which is adapted to power a sanding implement coupled to the drive motor. A first head assembly which includes a drum sanding implement is adapted to be removably connected to the main housing so that the drum sanding implement is positioned to be coupled to the drive motor. A second head assembly which includes a belt sanding implement is also adapted to be removably connected to the main housing so that the belt sanding implement is positioned to be coupled to the drive motor. A mounting plate is secured to the main housing.

A connect assembly is secured to each of the first sanding head assembly and the second sanding head assembly such that each of the connect assemblies is able to cooperate with the mounting plate, one at a time, to removably connect each of the first sanding head assembly and the second sanding head assembly to the main housing. The floor sander may also comprise a third head assembly which includes a third sanding implement. A third connect assembly is attached to the third head assembly for allowing removable connection to the mounting plate such that the third sanding implement is positioned to be coupled to the drive motor.

The mounting plate includes a generally flat surface with an outwardly extending alignment device and a plurality of outwardly extending locking pins. The mounting plate is adapted for removable connection with each of the connect assemblies on each of the sanding heads. The outwardly extending alignment device is generally a short post or shaft having a generally rectangular cross-sectional shape with tapering sides. The plurality of outwardly extending locking pins are cylindrical pins each being generally perpendicular to the surface of the mounting plate.

Each of the connect assemblies includes an alignment plate having an alignment bore for removably receiving the alignment device. The alignment plate also includes a plurality of locking pin bores for removably receiving each of the locking pins. A plurality of locking devices are used in conjunction with the locking pin bores to releasably secure the alignment plate against the mounting plate.

Each locking device is fully incorporated within an alignment plate and includes a rotatable cam shaft which has a cam-shaped portion. The rotatable cam shaft is positioned in the alignment plate such that the cam-shaped portion can be rotated into the adjacent locking pin bore and engage an inserted locking pin. Thus, when a sanding head assembly is desired to be mounted on the main housing, the alignment plate is placed against the mounting plate and the plurality of locking pins are inserted into the locking pin bores. Each of the rotatable cam shafts is rotatable such that each of the cam portions is rotated into the locking pin bores and engages each of the locking pins. This secures both the cam shafts and the locking pins. A set screw within the alignment plate is used to retain each of the rotating cam shafts within the alignment plate while still allowing rotation.

In another aspect of the present invention, the alignment plate includes a plurality of alignment slots. These slots are used to position and align the incorporated sanding implement to the desired sanding position and orientation against the surface to be sanded. This positioning and alignment is accomplished through use of a plurality of adjustment fasteners connected with each of the sanding head assemblies.

In yet another aspect of the present invention, the floor sander includes a quick connect/disconnect assembly for use with a plurality of interchangeable sanding head assemblies such that each of the sanding head assemblies can be removably attached to the floor sander one at a time. The quick connect/disconnect assembly of the present invention comprises a mounting plate secured to a main housing of the floor sander and a number of connect assemblies, each of which is secured to an individual and interchangeable sanding head assembly. The mounting plate has a generally flat surface for interface with each of the connect assemblies and includes a plurality of outwardly extending locking pins. Each of the locking pins is generally perpendicular to the surface of the mounting plate.

Each of the connect assemblies includes an alignment plate which also has a generally flat surface. Each alignment plate also includes a plurality of locking pin bores specifically situated to removably receive the locking pins extending from the mounting plate. A plurality of rotatable cam lock assemblies is used to engage and lock each of the locking pins within the alignment plate and thus secure the sanding head assembly to the main housing of the floor sander.

The mounting plate also includes an outwardly extending alignment device such as a short rectangular post. In a like fashion, the alignment plate includes an alignment bore specifically adapted to receive the alignment device onto the mounting plate. When the alignment device is inserted into the alignment bore the attached sanding head assembly is forced to align with the floor sander main housing. Both the alignment device and the alignment bore are provided with tapered sides to facilitate this alignment.

Another feature of the present invention includes a method for sanding a surface using a floor sander having a main housing, a drive motor attached to the main housing and a plurality of interchangeable sanding head assemblies. The method comprises the steps of first connecting a first sanding head assembly which has a first sanding implement to the main housing. A portion of the surface is then sanded using the first sanding implement. The first sanding head assembly is then removed from the main housing and a second head assembly which has a second sanding implement is connected to the main housing. A second portion of the surface is then sanded.

The step of connecting the first sanding head assembly to the main housing includes engaging a mounting plate secured to the main housing with a first connect assembly secured to the first sanding head assembly such that each of a plurality of locking pins extends outwardly from the mounting plate enters each of the plurality of locking pin bores in the first connect assembly. A plurality of locking devices in the first connect assembly is then actuated such that each locking device engages each of the locking pins to secure the first sanding head to the main housing. A drive motor mounted in the main housing is then coupled with the first sanding implement.

The invention, together with additional features and advantages thereof, which was only summarized in the foregoing passages, will become more apparent to those of skill in the art upon reading the description of the preferred embodiments, which follows in this specification, taken together with the following drawings.

DESCRIPTION OF THE PREFERRED EMBODIMENTS

Figure 1:
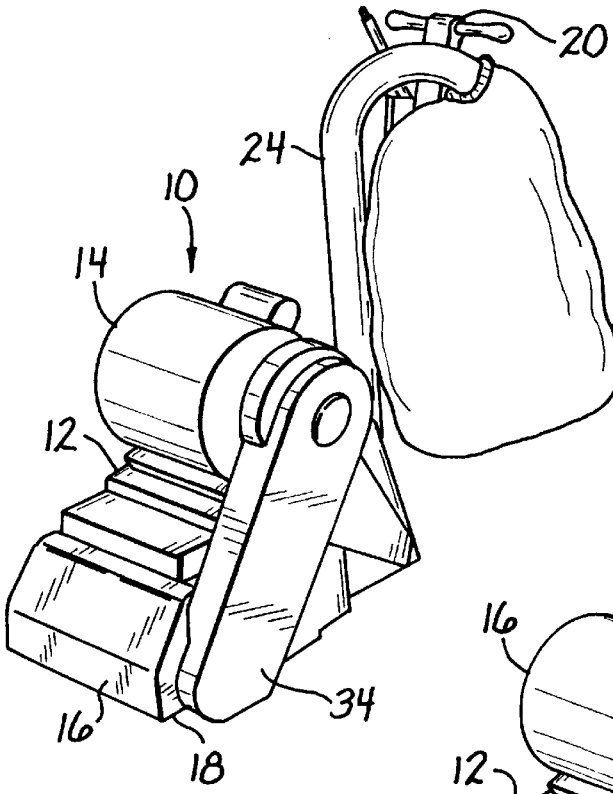
FIG. 1 is a perspective view of an embodiment of a floor sander according to the principles of the present invention.
Figure 2:
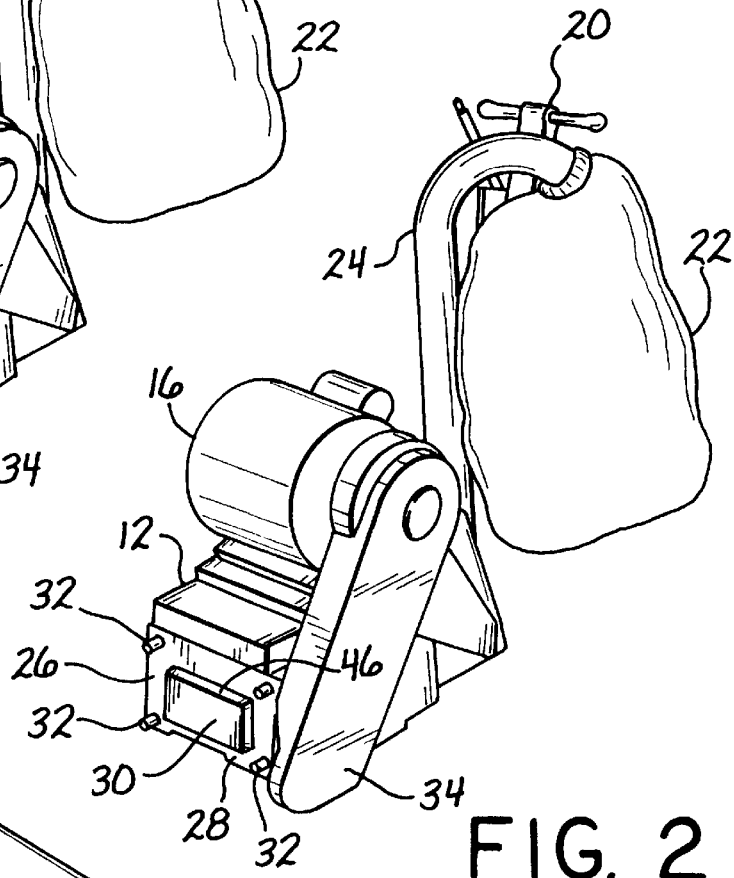
FIG. 2 is a perspective view of the floor sander shown in FIG. 1 without a sanding head assembly.

FIGS. 1–2 show a floor sander 10 for sanding a surface such as a hardwood floor. The floor sander 10 generally includes a main housing 12, a drive motor 14 and a removable first sanding head assembly 16. The drive motor 14 is removably coupled to the first sanding head assembly 16 and powers a first sanding implement 18 supported within the first sanding head assembly 16. An operator control device such as a handle assembly 20 may be attached to the main housing 12 for guiding and generally controlling the floor sander 10. The operator control device 20 may include power control, sanding speed control, steering controls, and any other controls associated with sanding a surface. A vacuum bag 22 and associated ducting 24 may also be connected to the main housing 12 for the removal and storage of sanded material and any associated dust. Handles (not shown) may be provided on the main housing 12 as well as on the sanding head assembly 16 to facilitate moving and orientation of the floor sander 10.

FIG. 2 shows the floor sander 10 as shown in FIG. 1 with the interchangeable sanding head assembly 16 removed. A mounting plate 26 which is used to align and support the sanding head assembly 16 is shown secured to the main housing 12. The mounting plate 26 may include generally flat surface 28, an alignment device 30 and a plurality of locking pins 32. The mounting plate 26 is oriented on the main housing 12 such that the sanding head assembly 16 is properly supported and aligned with the surface to be sanded. The mounting plate 26 is also oriented such that the sanding implement 18 may be readily coupled to the drive motor 14. A drive cover 34 is used to shield the drive motor 14, the sanding implement 18 and a coupling device (not shown) which may be a belt, chain, or any other coupling device as known in the art. For example, FIG. 1 illustrates a coupling belt 35 which is coupled to drive motor 14 and positioned on shaft 37 of sanding implement 18 to couple the drive motor and sanding implement and to transfer power from the drive motor to the sanding implement. The coupling belt 35 is easily and quickly decoupled from sanding implement 18 by removing sanding head assembly 16 from sander 10, as shown in FIG. 2.

Figure 3:
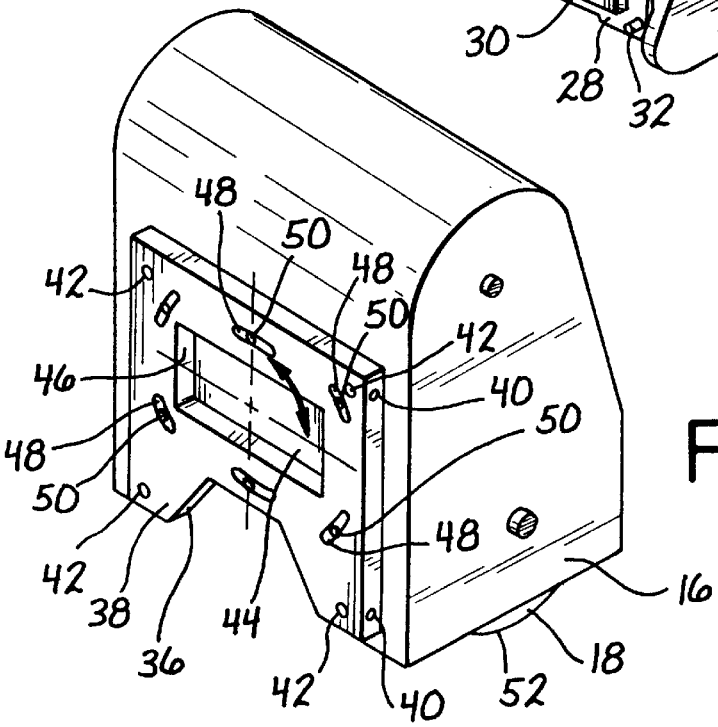
FIG. 3 is a perspective view of a first sanding head assembly.

Referring now to FIG. 3, the first sanding head assembly 16 is shown removed from the floor sander 10. A first connect assembly 36 is attached to the first sanding head assembly 16. This attachment may be accomplished using fasteners, welding, or any other method as is known. The first connect assembly 36 may even be an integral part of the sanding head assembly 18. The first connect assembly 36 allows for the removable connection with the mounting plate 26 of the floor sander 10. The first connect assembly 36 may include an alignment plate 38 and a plurality of locking devices 40.

The first sanding head assembly 16 also includes a first sanding implement 18, which may be a belt sanding implement, a drum sanding implement or any other type of sanding, polishing or other device used to finish a surface such as a hardwood floor. The first sanding implement 18 is fully supported and contained within the first sanding head assembly 16. However, a drive connector (not shown) may be provided on the sanding head assembly 16 for connection with a drive coupler (not shown). Access to the sanding implement 18 may be achieved when the sanding head assembly 16 is either attached or removed from the main housing 12.

The alignment plate 38 is generally configured to be coupled with the mounting plate 26. In this fashion, the alignment plate 38 may have flat surface with a plurality of locking pin bores 42. Each of these bores 42 is configured to removably receive a locking pin 32 extending outwardly from the mounting plate 26. An alignment bore 44 may be provided within the alignment plate 38 for removably receiving the alignment device 30 extending outwardly from the mounting plate 26. In this fashion, the outwardly extending alignment device 30 will be forced to enter into the alignment bore 44 when the generally flat surface 28 of the mounting plate 26 is flush with the flat surface of the alignment plate 38. Both the alignment device 30 and the alignment bore 44 may be provided with tapered sidewalls 46 to facilitate entry and alignment of the alignment device 30 into the alignment bore 44. Alignment of the first sanding head assembly 16 with the main housing 12 insures that the drive motor 14 may be properly coupled with the first sanding implement 18. In addition, the alignment device 30 when secured in the alignment bore 44 may also provide strength against torsional forces encountered when sanding.

To insure that the first sanding implement 18 is properly aligned with the surface to be sanded, the alignment plate 38 may be provided with a plurality of alignment slots 48 and alignment fasteners 50. In this way, the alignment plate 38 may be adjustably secured to the first sanding head assembly 16 such that the first sanding implement 18 is properly oriented against the surface to be sanded. A plurality of alignment fasteners 50 which may be socket-head cap screws, flathead alien bolts or any other counter-sunk type fasteners may be used to secure the alignment plate 38 through the alignment slots 48 to the first sanding head assembly 16. Loosening of the alignment fasteners 50, allows the alignment plate 38 to be rotated about the alignment slots 48 until the first sanding implement 18 is properly aligned. Alignment fasteners 50 may then be tightened such that the alignment plate 38 is secured to the first sanding head assembly 16.

Figure 4:
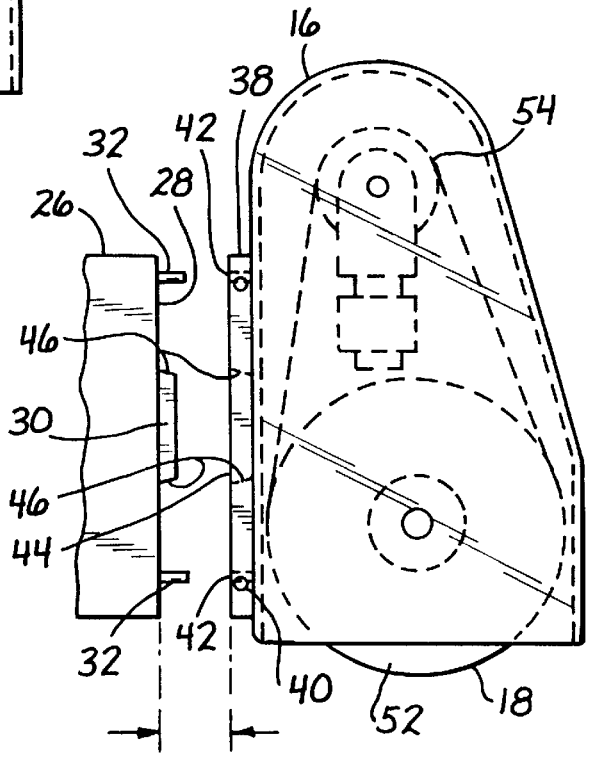
FIG. 4 is a side view showing the sanding head assembly of FIG. 3 adjacent a mounting plate.

Referring now to FIG. 4, the first sanding head assembly 16 is shown adjacent the main housing 12 so that the first connect assembly 36 is aligned with the mounting plate 26. As can be seen in the figure, first sanding implement 18 comprises a belt sanding implement 52, including a belt tensioning device 54. The first sanding head assembly 16 is aligned such that the first connect assembly 36, and in particular, the alignment plate 38, is aligned with the mounting plate 26. In this fashion, the locking pins 32 are aligned with the locking pin bores 42 in the alignment plate 38. The alignment device 30, when provided, is also aligned with the alignment bore 44 in the alignment plate 38. In this fashion, the first sanding head assembly 16 may be coupled with the main housing 12 such that the alignment plate 38 is flush with the generally flat surface 28 on the mounting plate 26. Each locking device 40 is then actuated to secure the locking pins 32 into the locking pin bores 42 and thus secure the first sanding head assembly 16 to the main housing 12.

Figure 5:
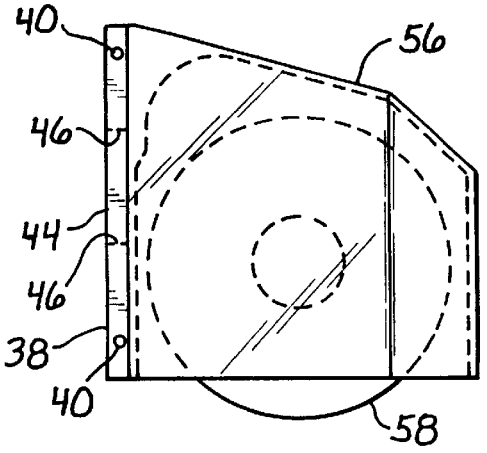
FIG. 5 is a side view of a second sanding head assembly.

FIG. 5 shows a second sanding head assembly 56 including a second sanding implement 58. A second connect assembly 60 is secured to the second sanding head assembly 56 in a similar fashion to the first connect assembly 36 and the first sanding head assembly 16. The second connect assembly 60 may be essentially identical to the first connect assembly 36 such that the second sanding head assembly 56 is removably connectable to the mounting plate 26 in a similar fashion. In this way, either the first sanding head assembly 16 or the second sanding head assembly 56 may be interchangeably mounted to the main housing 12, one at a time. A third sanding head assembly (not shown), including a third sanding implement and a third connect assembly, may also be provided. In this way, any number of sanding head assemblies may be provided and interchangeably mounted against the mounting plate 26.

Figure 6:
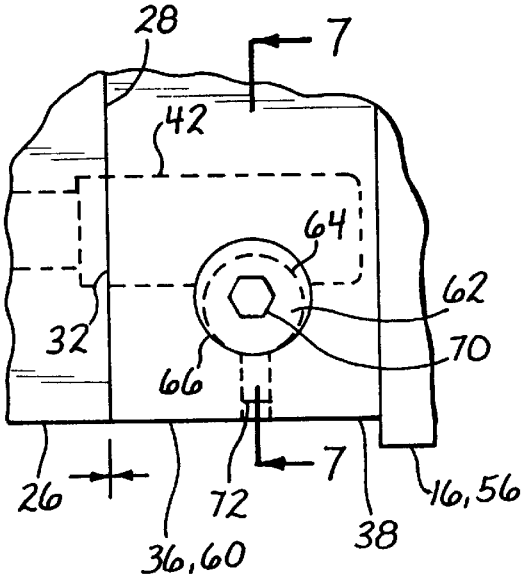
FIG. 6 is a schematic view showing a portion of the mounting plate with a secured sanding head assembly as shown in FIG. 1.
Figure 7:
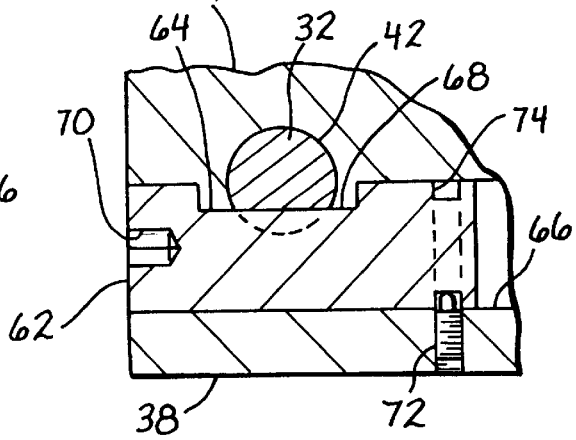
FIG. 7 is a cross-sectional view along lines 7—7 of FIG. 6.

Referring now to FIGS. 6–7, an embodiment of the locking devices 40 of the present invention, will be described in greater detail. For illustrative purposes only, the first sanding head assembly 16 is shown attached to the main housing 12 and will be described. However, any sanding head assembly such as the second sanding head assembly 56 may be shown attached to the main housing 12 and described in a similar fashion, using similar locking devices 40.

FIG. 6 is a partial view of the floor sander 10 illustrating the inner connection between the mounting plate 26 and the alignment plate 38 at each of the locking device 40 locations. As shown in the figure, each locking pin 32, which may be a cylindrical shaft extending outwardly from the generally flat surface 28 of the mounting plate 26, is inserted into an associated locking pin bore 42 within the alignment plate 38. The locking pins 32 may also be square, rectangular or any other cross-sectional shape that allows sufficient cross-sectional area and strength to support the sanding head assembly 16. One or more of the locking pins 32 may also be of a different cross-sectional area or shape than the remaining locking pins 32. Each of the locking pin bores 42 is specifically configured to receive an associated locking pin 32 such that the alignment plate 38 is generally aligned and supported flush against the mounting plate 26. The locking pin bores 42 may be of similar cross-sectional shape but slightly oversized to allow ease of installation and room for imperfect tolerancing. If an alignment device 30 is provided on the mounting plate 26, the oversizing of the locking pin bores 42 may be increased due to a lesser need for alignment from the plurality of locking pins 32. Once the sanding head assembly 16 is attached to the main housing 12 such that the alignment plate 38 is flush with the mounting plate 26, each locking device 40 may be actuated to engage and lock each of the locking pins 32 within the alignment plate 38.

Each of the locking devices 40 may include a rotatable cam shaft 62 which is contained within the alignment plate 38 adjacent each locking pin bore 42. The rotatable cam shaft 62 may include a centrally disposed cam portion 64 which has an increasing diameter around the circumference of the cam portion 64 of the rotatable cam shaft 62. Each rotatable cam shaft 62 is rotatably mounted into a cam shaft bore 66 within each alignment plate 38. The cam shaft bore 66 is located adjacent each locking pin bore 42 and slightly overlaps such that when the enlarged cam portion 64 of the rotatable cam shaft 62 is rotated, the cam portion 64 enters the locking pin bore 42. Thus, the cam portion 64 actually overlaps each locking pin bore 42 effectively reducing its diameter. In this way, an inserted locking pin 32 may be engaged by the cam portion 64 and physically retained within the alignment plate 38.

Each cam portion 64 may also be provided with a slot or flat portion 68 which acts as a mechanical lock against each of the locking pins 32. In a like fashion, each locking pin 32 may also be provided with a flat portion, a groove or some other shape specifically configured to engage with the cam portion 64 such that each locking pin 32 is engaged by a cam portion 64 and mechanically locked within each locking pin bore 42. A head or drive portion 70 is provided on each rotatable cam shaft 62 which allows for mechanical rotation or actuation. The head portion may include an internal allen head, an external bolt head or any other means for torquing the rotatable cam shaft 62.

A locking set screw 72 may be used to retain each rotatable cam shaft 62 within each alignment plate 38. The locking set screw 72 may be threaded within a bore in the alignment plate 38 adjacent each locking pin bore 42 and engage a groove 74 in each rotatable cam shaft 62. In this way, each rotatable cam shaft 62 is mechanically retained within the alignment plate 38.

In a typical surface sanding operation, the floor sander 10 is provided with a plurality of interchangeable sanding head assemblies. In particular, a first sanding head assembly 16 may be provided for one type of sanding and a second sanding head assembly 56 may be provided for a second type of sanding. Additional sanding head assemblies may also be provided, allowing for alternative types of sanding or polishing. The first sanding head assembly 16 includes a first sanding implement 18 which may be a belt-type sanding implement 52. In this configuration, a sanding belt drum, sanding belt and a sanding belt tensioning device 54 are incorporated within the first sanding head assembly 16 as is known in the art. The first sanding head assembly 16 may be attached to the main housing 12 and coupled to the drive motor 14 when a belt sanding device is desired.

The second sanding head assembly 56 includes a second sanding implement 58 which may be a drum-type sanding implement. Thus the floor sander 10 may be fitted with either the first sanding head assembly 16, the second sanding head assembly 56 or any other similarly configured sanding head assembly.

To sand a surface, such as a hardwood floor, an operator attaches a first sanding head assembly 16 having a first sanding implement 18 to the main housing 12. The first sanding head assembly 16 is attached using the first connect assembly 36 in conjunction with the mounting plate 26 as previously described. At least a first portion of the surface is sanded using the first sanding implement 18. As previously described, the first sanding implement 18 may be a belt-type sanding implement 52, however, in many applications, it is preferred to utilize a drum-type sanding device such as a drum sanding implement 58 which may be included in the second sanding head assembly. Thus, an operator may elect to attach either of the first sanding head assembly 16 or the second sanding head assembly 56 depending upon the surface to be sanded and the desired surface finish.

After sanding with the first sanding implement 18, the first sanding head assembly 16 is removed from the main housing 12 and the second sanding head assembly 56 having a second sanding implement 58 is connected to the main housing 12. In a similar fashion, a second connect assembly 60 is used to attach the second sanding head assembly 56 to the main housing 12 as previously described. A second portion of the surface, which may include part of the first portion, is then sanded. In a like fashion, a second sanding head assembly 56 may be removed from the main housing and a third sanding head assembly having a third sanding implement may be attached and utilized. Each of the individual sanding head assemblies 16 and 56 may be interchangeably utilized for sanding specific portions of the surface, or, alternatively, may be utilized in sequential fashion such that the surface is first sanded using one sanding implement and then finished using a second and possibly third sanding implement.

While this invention has been described with respect of various specific examples and embodiments, it is to be understood that the invention is not limited thereto and that it can be variously practiced within the scope of the following claims.

What is claimed is:

1. A floor sander comprising:

a main housing including a drive motor adapted to power a sanding implement coupled to said drive motor;

a first sanding head assembly including a belt-type sanding implement and being adapted to be removably connected to said main housing so that said belt-type sanding implement is positioned to be coupled to said drive motor;

a second sanding head assembly including a drum-type sanding implement and being adapted to be removably connected to said main housing so that said drum-type sanding implement is positioned to be coupled to said drive motor;

a mounting plate secured to said main housing; and two connect assemblies, each of which is secured to a different one of said first head assembly and said second head assembly, said mounting plate being adapted to cooperate with each of said connect assemblies, one at a time, to removably connect said first head assembly and said second head assembly, one at a time to said main housing.

2. The floor sander as recited in claim 1 further comprising a third sanding head assembly including a third sanding implement and a third connect assembly being adapted to be removably connected to said mounting plate so that said third sanding implement is positioned to be coupled to said drive motor.

3. The floor sander as recited in claim 1 further comprising a handle assembly attached to said main housing for guiding and generally controlling said floor sander.

4. The floor sander as recited in claim 1 wherein said mounting plate comprises a generally flat surface having an outwardly extending alignment device and a plurality of outwardly extending locking pins for removable connection with each of said connect assemblies.

5. The floor sander as recited in claim 4 wherein each of said connect assemblies comprises an alignment plate having an alignment bore for removably receiving said alignment device and a plurality of locking pin bores for removably receiving each of said locking pins, said alignment plate being fitted with a plurality of locking devices for releasably securing said alignment plate with said mounting plate.

6. The floor sander as recited in claim 5 wherein each of said alignment plates further comprises a plurality of alignment slots and adjustment fasteners for aligning each of said sanding implements on said surface using each of said adjustment fasteners.

7. The floor sander as recited in claim 5 wherein each of said plurality of locking devices comprises a rotatable cam shaft having a cam portion for engaging one of said plurality of locking pins when said locking pin is inserted into said locking pin bore and said cam portion is rotated into said locking pin.

8. The floor sander as recited in claim 7 further comprising a plurality of set screws, each of said set screws for mechanically retaining each of said rotatable cam shafts within said alignment plate while allowing each of said rotatable cam shafts to rotate.

9. A floor sander comprising:

a main housing including a drive motor adapted to power a sanding implement coupled to said drive motor;

a handle assembly attached to said main housing for guiding and generally controlling said floor sander;

a mounting plate secured to said main housing; and a first sanding head assembly including a first sanding implement and a first connect assembly adapted to be removably connected to said mounting plate so that said sanding implement is positioned to be removably coupled to said drive motor and said first head assembly is removably connected to said main housing.

10. The floor sander as described in claim 9 and further comprising a second sanding head assembly including a second sanding implement and being adapted to be removably connected to said mounting plate so that said second sanding implement is positioned to be coupled to said drive motor and said second head assembly is removably connected to said main housing wherein said first and said second head assemblies are interchangeably mounted on said mounting plate.

11. A quick connect/disconnect assembly for use with a floor sander having a plurality of interchangeable sanding head assemblies such that each sanding head assembly may be removably attached to said floor sander, one at a time, said quick connect/disconnect assembly comprising:

a mounting plate attached to said floor sander, said mounting plate having a generally flat surface and a plurality of locking pins extending outwardly from said flat surface and;

a connect assembly, including an alignment plate having a plurality of locking pin bores, secured to each of said interchangeable sanding head assemblies, said connect assembly also including a plurality of lock assemblies, each for engaging and securing a locking pin within each of said locking pin bores.

12. The quick connect/disconnect assembly as described in claim 11 wherein said mounting plate further includes an outwardly extending alignment device and said alignment plate further includes an alignment bore such that when said alignment device is inserted into said alignment bore, the attached sanding head assembly is aligned with said floor sander.

13. The quick connect/disconnect assembly as described in claim 12 wherein said alignment device comprises a post having a generally rectangular cross-sectional shape and generally tapering sides.

14. The quick connect/disconnect assembly as described in claim 11 wherein each of said lock assemblies comprises a rotatable shaft having a cam portion.

15. The quick connect/disconnect assembly as described in claim 14 wherein each of said rotatable shafts further comprises a head portion for mechanically rotating said shaft.

16. A method of sanding a surface using a floor sander having a main housing, a drive motor attached to said main housing, and a plurality of interchangeable sanding head assemblies, each of which is removably connected to said main housing, one at a time, said method comprising the steps of:

connecting a first sanding head assembly having a first sanding implement to said main housing;

sanding at least a first portion of the surface using the first sanding implement;

removing the first sanding head assembly from said main housing;

connecting a second sanding head assembly having a second sanding implement to said main housing; and sanding at least a second portion of the surface.

17. A method of sanding a surface as recited in claim 16 wherein the step of connecting a first sanding head assembly comprises the steps of:

engaging a mounting plate secured to said main housing with a first connect assembly on said first sanding head assembly such that each of a plurality of locking pins extending outwardly from said mounting plate enter each of a plurality of locking pin bores in said first connect assembly;

actuating a plurality of locking devices in said first connect assembly such that each locking device engages each of said locking pins to secure said first sanding head to said main housing; and coupling a drive motor mounted in said main housing with said first sanding implement.

18. A method of sanding a surface as recited in claim 17 further comprising the step of aligning the first connect assembly with said first sanding head assembly such that the first sanding implement is aligned with the surface to be sanded.

19. A method of sanding a surface as recited in claim 18 wherein the step of connecting a first sanding implement comprises connecting a sanding implement comprising a rotatable sanding drum operably mounted within said first sanding head assembly.

20. A method of sanding a surface as recited in claim 19 wherein the step of connecting a second sanding implement comprises connecting a sanding implement comprising a belt sanding device operably mounted within said second sanding head assembly.

* * * * *